US007785238B2

(12) United States Patent
Thulin

(10) Patent No.: US 7,785,238 B2
(45) Date of Patent: Aug. 31, 2010

(54) TRAINING MACHINE FOR STRENGTHEN TRAINING AND REHABILITATION

(76) Inventor: Mats Thulin, Gösvägen 28, SE-181 30 Lidingö (SE)

( * ) Notice: Subject to any disclaimer, the term of this patent is extended or adjusted under 35 U.S.C. 154(b) by 0 days.

(21) Appl. No.: 11/454,973

(22) Filed: Jun. 19, 2006

(65) Prior Publication Data

US 2007/0149367 A1 Jun. 28, 2007

(30) Foreign Application Priority Data

Sep. 29, 2005 (SE) ..... 0502155

(51) Int. Cl.
*A63B 21/00* (2006.01)
*A63B 21/062* (2006.01)

(52) U.S. Cl. ..... 482/100; 482/98; 482/137

(58) Field of Classification Search ..... 482/92, 482/93, 94, 95, 96, 97, 98, 99, 100, 101, 482/102, 112, 133–138
See application file for complete search history.

(56) References Cited

U.S. PATENT DOCUMENTS 3,573,865 A * 4/1971 Annas et al. ..... 482/5
3,843,119 A * 10/1974 Davis ..... 482/131
4,563,003 A 1/1986 Bugallo
4,600,188 A * 7/1986 Bangerter et al. ..... 482/79
4,609,189 A 9/1986 Brasher
4,648,594 A 3/1987 Schleffendorf
4,765,610 A * 8/1988 Sidwell ..... 482/94
4,765,611 A * 8/1988 MacMillan ..... 482/98
4,786,051 A * 11/1988 Mullican ..... 482/138
4,848,738 A * 7/1989 Mueller ..... 482/98
4,953,855 A * 9/1990 Shields ..... 482/99
5,058,884 A * 10/1991 Fuller, Sr. ..... 482/97
5,147,263 A * 9/1992 Mueller ..... 482/112
5,151,072 A * 9/1992 Cone et al. ..... 482/104
5,263,915 A * 11/1993 Habing ..... 482/99
5,336,148 A * 8/1994 Ish, III ..... 482/98
5,435,798 A * 7/1995 Habing et al. ..... 482/5
5,637,063 A * 6/1997 Fuller, Sr. ..... 482/97
5,643,151 A * 7/1997 Naimo ..... 482/98
5,643,157 A * 7/1997 Seliber ..... 482/112
5,667,463 A * 9/1997 Jones ..... 482/97
5,749,813 A * 5/1998 Domzalski ..... 482/97

(Continued)

FOREIGN PATENT DOCUMENTS

GB 2 227 676 A 8/1990

*Primary Examiner*—Loan H Thanh
*Assistant Examiner*—Daniel Roland
(74) *Attorney, Agent, or Firm*—Birch, Stewart, Kolasch & Birch, LLP

(57) ABSTRACT

A training machine for strength training and rehabilitation comprising has pull or press devices, which are arranged to be moved backwards and forwards while a pre-determined number of weights in a weight package is arranged to be lifted and lowered, alternatively, by a connection, and a device to lift said pre-determined number of weights in a continuous movement by a first user intended powered force against said pull or press device and to lower said pre-determined number of weights by a second user intended powered force against said pull or press devices. The first power being less than the second power. The training machine comprises a frame carrying the weights and along which the weights are slidable and which is turnably journalled about a substantially horizontal turning axis.

16 Claims, 6 Drawing Sheets

U.S. PATENT DOCUMENTS 5,788,615 A * 8/1998 Jones ..... 482/97
5,788,616 A * 8/1998 Polidi ..... 482/104
5,931,767 A * 8/1999 Morales ..... 482/102
6,050,920 A * 4/2000 Ehrenfried ..... 482/6
6,436,013 B1 * 8/2002 Krull ..... 482/94
6,482,135 B1 * 11/2002 Ish et al. ..... 482/97
RE38,057 E * 4/2003 Pandozy ..... 482/97
6,824,505 B1 * 11/2004 Chang ..... 482/95
6,971,978 B2 * 12/2005 Hyder ..... 482/142
7,029,426 B1 * 4/2006 Fuller, Sr. ..... 482/97
7,074,164 B2 * 7/2006 Moring et al. ..... 482/112
7,101,322 B2 * 9/2006 Carle ..... 482/97
2003/0078141 A1 * 4/2003 Webber ..... 482/100
2003/0100413 A1 * 5/2003 Huang ..... 482/100
2003/0195091 A1 * 10/2003 Webber et al. ..... 482/100
2004/0029688 A1 * 2/2004 Webber et al. ..... 482/142
2006/0116254 A1 * 6/2006 Webber et al. ..... 482/94
2006/0264304 A1 * 11/2006 Habing ..... 482/98

* cited by examiner

TRAINING MACHINE FOR STRENGTHEN TRAINING AND REHABILITATION

The present invention is related to a training machine for strength training and rehabilitation.

There are already many known training machines for anaerobic training where the user exercises intended muscles of the body by performing pre-determined movements so that a weight package of a weight stack is lifted or lowered. For efficient training with single joint movements, as by means of a biceps curl machine or a leg extension machine, as well as with multiple-joint movements, as by means of a rowing machine, a bench press machine or a leg press machine, it is important that the user of the machine can perform a number of positive and negative working cycles intended for the personal capacity of the training person. The positive work means that weights are being lifted and the negative work means that weights are being lowered.

In U.S. Pat. No. 4,648,594 and GB Patent 2,227,676 machines are previously known, at which the load increases during the positive movement and is reduced to its original value at the end of the negative movement.

By instead varying the load so that, during the same total movement cycle, the positive working cycle becomes easier to perform, i.e., less force is required to lift the selected weight package than to lower it, the training person can lift a greater weight package than what was possible with a normal machine or alternatively perform more movements during one and the same workout session.

A machine of the type defined above is shown and described in U.S. Pat. No. 4,563,003. This machine has a rod which is pressed against the weight package during the negative movement to increase the load when the weight package moves downwards. To provide a constantly increased load during the negative movement an influence of the rod must occur directly dependent on the movement of the training person during the whole negative movement. If the training person increases or decreases the movement rate during the negative work the speed of the rod must be amended in the same proportion. Such a regulation is very complex and difficult to perform in practise.

The object of the present invention is to provide a training machine of the type mentioned above which sets aside the above-mentioned problem.

When a person lowers and lifts the same number of weights of a weight package, no consideration is taken to the fact that the negative, i.e., lowering, force of the person is greater than the positive, i.e., lifting, force of the person. Therefore, the effect of the training machine is limited. When training with conventional training machines the number of weights must be selected with regard to the weaker lifting strength of the training person. The same number of weights is thereafter lowered at the negative part of the movement. Hence, this number of weights is not on a level with the negative strength.

With the training machine according to the invention the negative strength can be trained with a more optimal weight mass in the selected weight package. The result will be that the fatigue rate of the trained muscle will increase. With this invention, it is possible to stimulate capacity improvement with less training amount than training with conventional training machines. Scientific studies have shown that training where the selected weight package is adapted to the negative strength provides faster and greater strength growth than training where the weight package is adapted to the positive strength.

BRIEF DESCRIPTION OF THE DRAWINGS

The invention is described in the following with reference to the appended drawings showing a preferred embodiment.

DETAILED DESCRIPTION OF THE INVENTION

Figure 1:
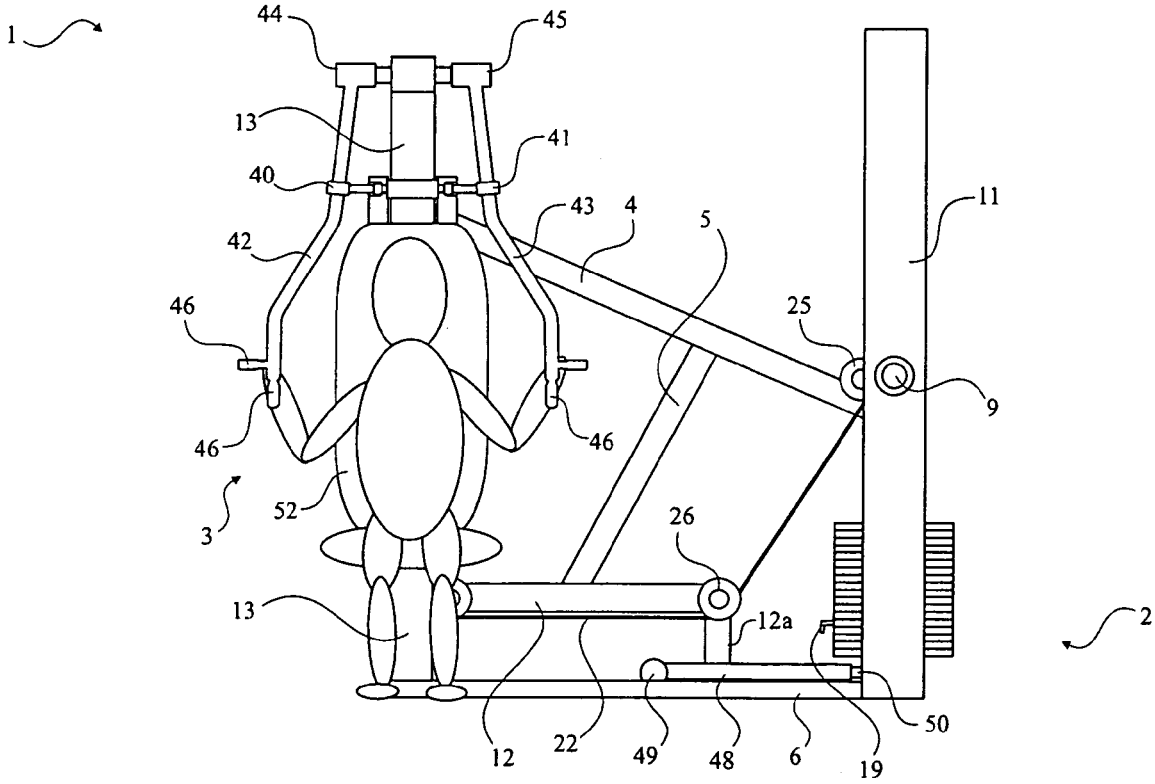
FIG. 1 shows a front view of an embodiment of a training machine for strength training and rehabilitation according to the invention.
Figure 2:
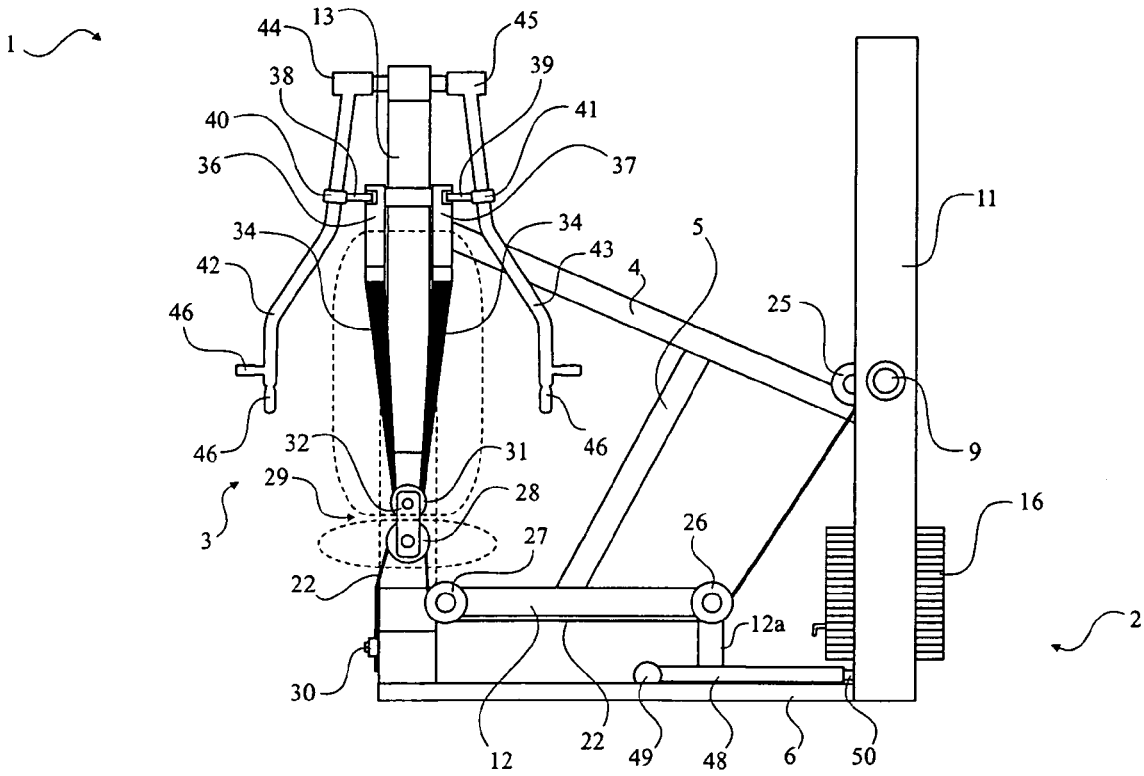
FIG. 2 shows the training machine in FIG. 1 where a person who uses the machine has been deleted and where a seat with supporting frame is shown with broken lines for clarity.
Figure 3:
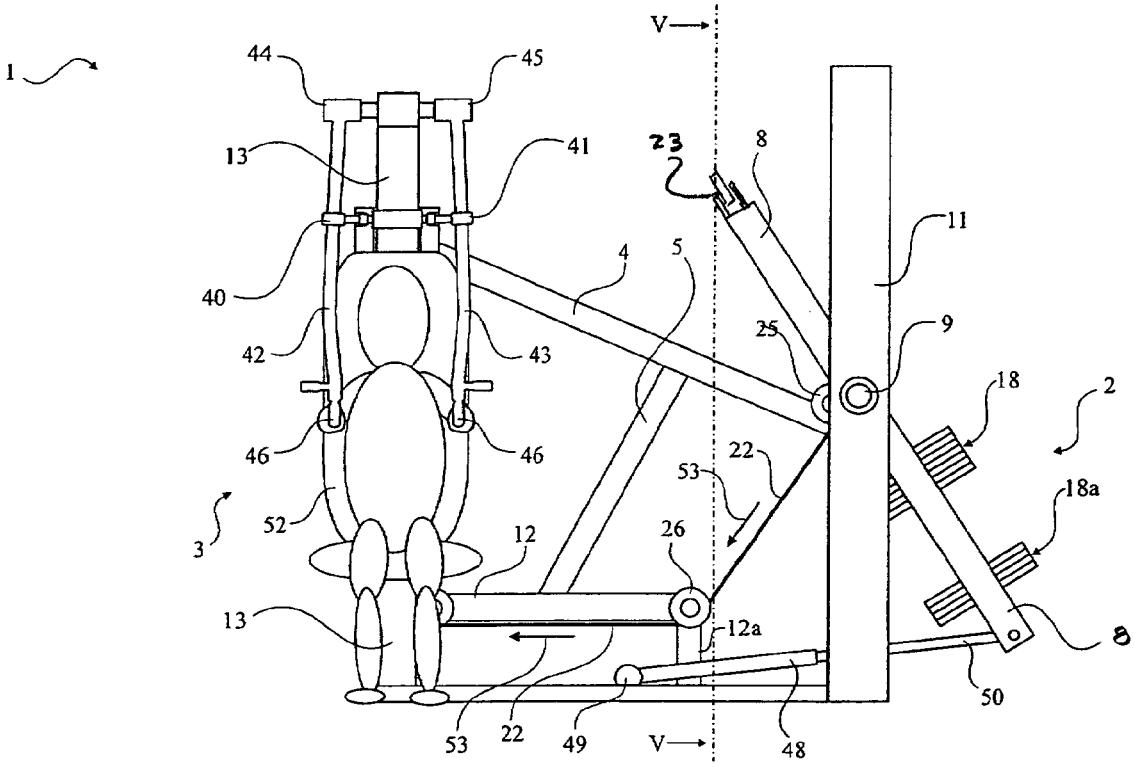
FIG. 3 shows the training machine of FIG. 1 in a positive movement position.
Figure 4:
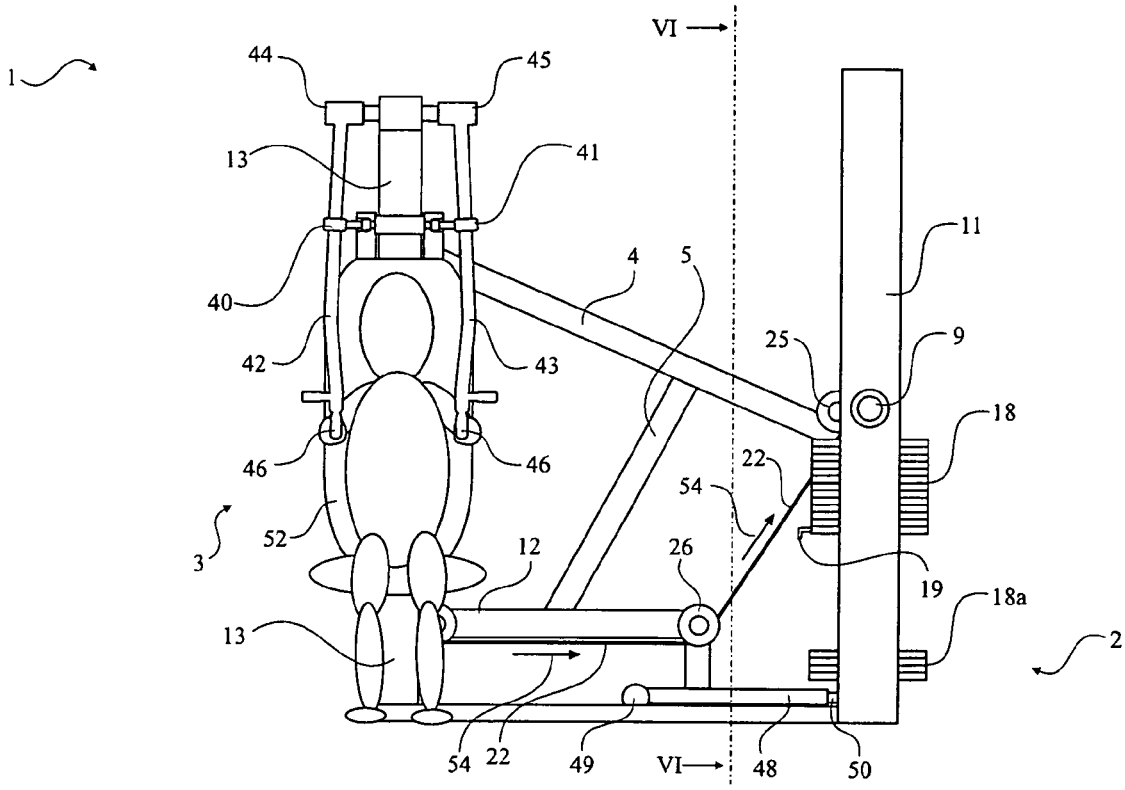
FIG. 4 shows the training machine of FIG. 1 in a negative movement position.
Figure 5:
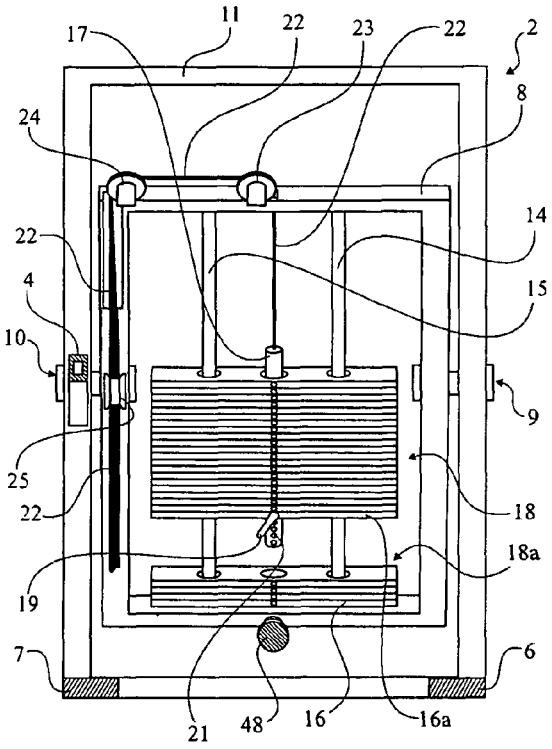
FIG. 5 shows a section along the line V-V in FIG. 3, where the machine is situated in a position for a positive movement.
Figure 6:
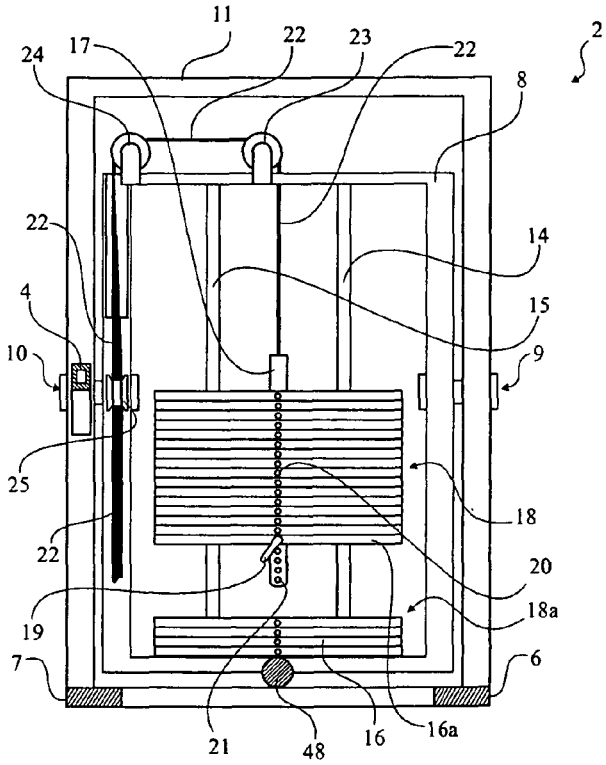
FIG. 6 shows a view like that in FIG. 5 of the machine, where the machine is situated in a position to perform a negative movement.
Figure 7:
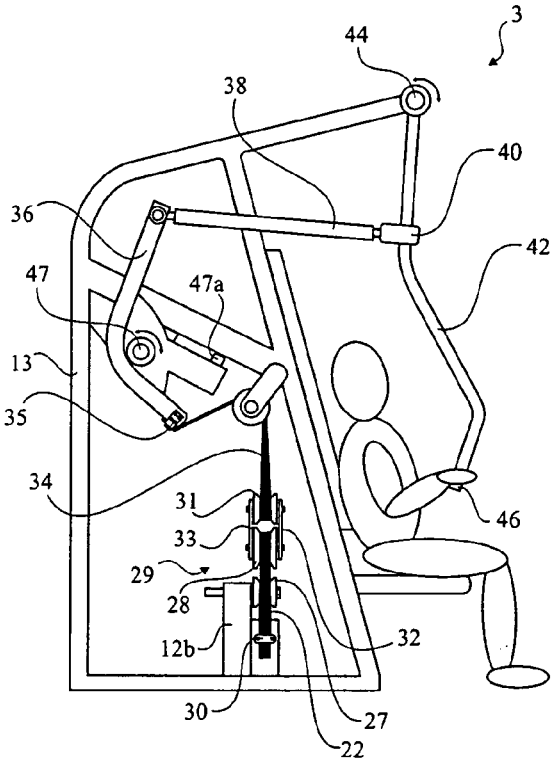
FIG. 7 shows a side view of the training machine of FIG. 1 in a position of rest.
Figure 8:
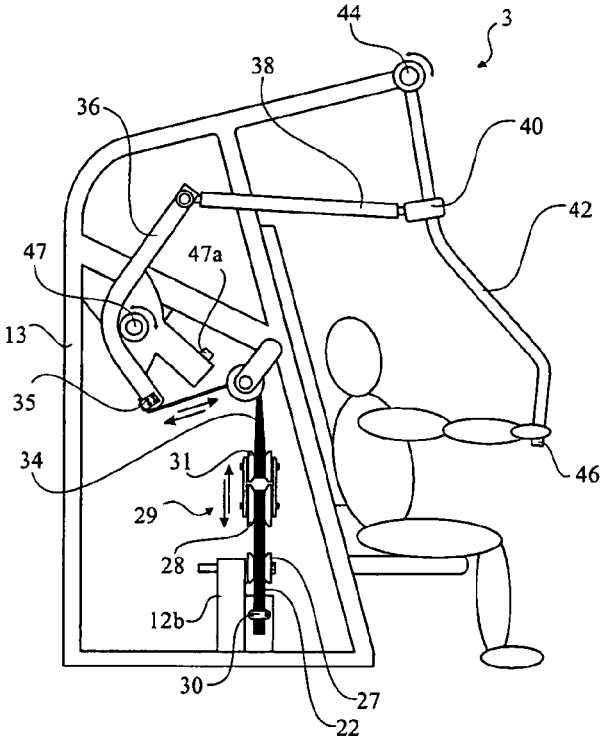
FIG. 8 shows a side view similar to that in FIG. 7 where the person is performing either a positive or a negative movement.

In FIG. 1-8 an embodiment of a training machine 1 for strength training and rehabilitation according to the invention is shown in which the machine comprises a weight stack section 2 and a training section 3, which are fixed connected to each other by means of inclined beams 4 and 5 as well as beams 6 and 7 which are arranged in a horizontal plane and fixed connected at the lower part of said sections 2 and 3. The weight stack section 2 has an inner substantially rectangular frame portion 8 (see FIGS. 5 and 6), which is turnably journalled in pivot pins 9 and 10 within an outer substantially rectangular frame part portion 11. A horizontal beam 12 is formed via vertical beams 12*a*, 12*b* fixed connected between beam 7 and the frame construction 13 of the training section. The lower end of the inclined beam 5 is fixed connected to the beam 12. The portions comprised in the frame construction of the training machine 1, which portions are fixed connected to each other, are advantageously welded to each other to achieve a solid construction, which shall be able to stand high loads concerning pull and press loads as well as vibrations.

Between the upper and lower horizontal beams of the inner frame portion 8 guide rods 14 and 15 are fastened. Along these guide rods 14 and 15 weights 16 of a weight stack are arranged to slide. The weights have holes for the guide rods 14 and 15, respectively, also a central hole for a lifting rod 17 (see FIG. 5), whereby a package 18 containing a pre-determined number of selected number of weights can be lifted by introducing a pin 19 through a hole 20 normal to the central hole through both the lowest weight 16*a* in the package 18, which is to be lifted, and a corresponding hole 21 in the lifting rod 17. A selected group of weights will be lifted while others 18*a* are not. Such corresponding holes 21 are arranged in front of all substantially horizontal holes 20 through the weights 16 of the weight stack, when the frame is vertical. Bearings (not shown), preferably ball or roller bearings, can be mounted in the holes 14*a* and 15*a* for the control rods 14 and 15 to reduce the friction at the displacement of the weights along the rods when the inner frame is inclined, which is to be described below. Lifting and lowering of the weight package 18 is performed by means of a non-elastic belt 22, preferably made by the material Kevlar®, aramid, which belt passes via pulleys 23 and 24 arranged on the upper beam of the inner frame portion 8. After the pulley 24 the belt extends along the side beam of the inner frame and is turned 90° to thereafter pass over and abut another pulley 25. From the pulley 25, which is arranged substantially on the same level as the pivot pins 9 and 10, the belt turns off obliquely downwards towards a pulley 26 mounted on the beam 12 (see FIGS. 1-4). The pulley 26 has been mounted substantially on the same level as the pivot pins 9 and 10 so that the tension in the belt will not influence the movement of the inner frame 8, which is described below. From the pulley 26 the path of the belt extends substantially horizontal towards a further pulley 27 mounted on the beam 12 and runs thereafter upwards through a pulley 28 of an equalisation device 29 to an attachment 30 which is provided on a protrusion on the beam 12*b*. The equalization device 29 comprises besides the pulley 28 a further pulley 31, which as the pulley 28 is journalled in freely hanging linkage arms 32 and 33. A further non-elastic belt 34, preferably made by the material Kevlar®, aramid, is mounted at its end by means of fastening devices 35 to the lower ends of arcuately extending turning arms 36 and 37, respectively. The equalisation device with the further belt 34 has been mounted in a well known way to equalize the power from the arms of the training person at loading towards the arms 42 and 43 which accordingly do not need to be moved away from the person the same distance to achieve effect because a person in most cases is not equally strong in both right and left arms.

At the opposite upper ends of the arms 36 and 37 linkage arms 38 and 39 are mounted, which are moveable in all directions, e.g., by means of a ball-and-socket joint. The arms 38 and 39 are in turn at their other ends in all directions freely moveably connected to couplings 40 and 41 mounted on pull and press arms 42 and 43, which in turn are freely turnably journalled at their upper ends on the frame construction 12 at 44 and 45, respectively. Handles 46 forming a pull or press means are provided at the lower ends of the arms 42 and 43. The turning arms 36 are journalled on a common through shaft 47 fastened at the frame construction 13. The turning arms 36 are freely journalled independently of each other on said shaft 47. A stop 47*a* restrains the movements of the turning arms in one direction of rotation.

In FIG. 1-6 a drive means 48 may be a hydraulic cylinder device or a linear electric motor is shown which at its one end 49 is mounted on a beam (not shown) which is fixed connected between the beams 6 and 7. The other end 50 of the drive means 48 which may be a hydraulic cylinder device or a linear electric motor is journalled at the lower cross beam 51 of the inner frame part 8. By activating the drive means 48, the inner frame 8 of the weight magazine portion 2 is arranged to rotate about the pivot pins 9 and 10, as is best evident from FIGS. 3 and 5. The drive means 48 is shown as an example of a device to turn the inner frame 8 in relation to the outer frame 11. Other known drive means devices to perform this work can of course be used within the present invention, as, e.g., the hydraulic cyclinder device or a linear electric motor or other devices etc.

A person who shall train using the strength training device 1 according to the invention sits on the chair 52 and then grips the handles 46 on the arms 42 and 43, as is evident from FIG. 1. To facilitate the positive movement, i.e., the person presses the arms 42 and 43 outwardly from the body, the inner frame is turned according to FIG. 3 so that the power which is required to lift the upper weight package 1 is reduced by the inclination of the inner frame 8, whereas the upper weight package 18 slides on the controller rods 14 and 15 and a reduction of the power which is required to press the handles forwards can be reduced with up to over 50%. The positive power which is required to lift the weights will be substantially less than the negative force, i.e., in the order of more than 30%, more precisely about 40%. When the person begins the negative movement, i.e., the person moves the arms 42 and 43 inwardly towards the body to a stop/start position where the stop 47*a* abuts against the frame construction 13, the inner frame 8 is turned back to its original vertical position in which the person achieves full load from the weight package 18. Turning the inner frame by means of the cylinder device 48 occurs suitably automatically by means of a control unit (not shown) which via censors censing the movement of the belt 22 and turning the inner frame against the position in FIG. 3 when the belt is moved in the direction of the arrows 53 and against the position in FIG. 4 when the belt moves in the direction of the arrows 54.

As shown in the above described preferred embodiment of the training machine according to the invention it is achieved that the trained person is given the possibility to either lift more weights than what is possible by means of a conventional known machine or lift more times with the same weight as was earlier used.

The training machine according to the invention can be modified within the scope of the appended claims.

The invention claimed is:

1. A training machine for strength training and rehabilitation comprising:

a fixed outer frame extending upwardly a predetermined height;

an inner frame having a proximal end and a distal end, said inner frame extending upwardly a predetermined height and being mounted within the fixed outer frame, said proximal end and said distal end being free ends of the inner frame not attached to the fixed outer frame, said proximal end is located at a top of said inner frame and said distal end is located at a bottom of said inner frame;

a turning axis operatively positioned between said fixed outer frame and said inner frame, said turning axis being substantially centrally disposed between the proximal end and the distal end of the inner frame for selectively enabling a pivoting movement of the inner frame relative to the outer frame;

pull or press means, which are arranged to be moved backwards and forwards while a pre-determined number of weights in one weight package is arranged to be slidably lifted and lowered, alternatively, by connection means, and wherein said pre-determined number of weights can be lifted in a continuous movement by a first user force against said pull or press means and then lowered by a second user force against said pull or press means, said first user force being less than said second user force, said inner frame carrying said weights and along which said weights are slidable during lifting and which is turnably journalled about said turning axis.

2. The training machine according to claim 1, wherein said turning axis is parallel to a lower substantial horizontal side of the inner frame.

3. The training machine according to claim 1 or 2, wherein said turning axis has two pivot pins which are provided on both sides of said inner frame and which are situated at a substantial distance from the proximal end of the inner frame.

4. The training machine according to claim 1 or 2, wherein said turning axis is a shaft.

5. The training machine according to any of claim 1 or 2, further comprising a linear electrical motor or a hydraulic cylinder device as a driving device, said driving device being arranged to move the inner frame backwards and forwards from a pre-determined inclined position turned about said turning axis and a substantially vertical position.

6. The training machine according to any of claim 1 or 2, wherein said first user force is substantially less than said second user force.

7. The training machine according to claim 1 or 2, wherein said connection means are constituted of at least one non-elastic belt, said belt being connected between said pull or press means and said pre-determined number of weights via a lever system and freely journalled pulleys arranged on the machine.

8. The training machine according to claim 7, wherein said non-elastic belt is passed from said pre-determined number of weights along the frame about a pulley which is arranged substantially on the level of said turning axis and further on the machine for connection to said pull or press means.

9. The training machine according to claim 3, wherein the pivot pins are at a middle of the inner frame.

10. The training machine according to claim 1, wherein the first user force is less than 30% of the second force.

11. The training machine according to claim 1, wherein the first user force is less than 40% of the second force.

12. The training machine according to claim 1, wherein the inner frame is inclined relative to a vertical direction during lifting of the weights and is vertical during the lowering of the weights.

13. The training machine according to claim 1, wherein the orientation of the inner frame relative to a vertical direction differs during lifting and lowering of the weights.

14. The training machine according to claim 1, wherein the turning axis about which the inner frame is journalled is vertically stationary during lifting and lowering of the weights.

15. A training machine for strength training and rehabilitation comprising:

a fixed outer frame extending upwardly a predetermined height;

an inner frame having a proximal end and a distal end, said inner frame extending upwardly a predetermined height and being mounted within the fixed outer frame, said proximal end and said distal end being free ends of the inner frame not attached to the fixed outer frame, said proximal end is located at a top of said inner frame and said distal end is located at a bottom of said inner frame;

a turning axis operatively positioned between said fixed outer frame and said inner frame, said turning axis being substantially centrally disposed between the proximal end and the distal end of the inner frame for selectively enabling a pivoting movement of the inner frame relative to the outer frame;

pull or press means arranged to be moved backwards and forwards while a predetermined number of weights in one weight package is arranged to be slidably lifted and lowered, alternatively, by connection means;

said inner frame initially supporting said weights in a substantially vertical position;

said turning axis enables said inner frame to be moved from said substantially vertical position to a predetermined angle; and drive means for inclining said inner frame between said substantially vertical position to the predetermined angle, wherein said predetermined number of weights can be lifted by a first user force against said pull or press means and then lowered by a second user force against said pull or press means, said first user force being less than said second user force, wherein said weights are slidable during lifting along said inner frame with the first user force when the inner frame is at the predetermined angle and are slidable lowered along said inner frame with the second user force when the inner frame is at the substantially vertical position.

16. The training machine according to claim 15, wherein the first user force is applied as a continuous movement for lifting the predetermined number of weights.

* * * * *